US008221062B2

(12) United States Patent
Liotta et al.

(10) Patent No.: US 8,221,062 B2
(45) Date of Patent: Jul. 17, 2012

(54) DEVICE AND SYSTEM FOR REDUCING SECONDARY AIR FLOW IN A GAS TURBINE

(75) Inventors: Gary Charles Liotta, Simpsonville, SC (US); Thomas Raymond Farrell, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 707 days.

(21) Appl. No.: 12/353,305

(22) Filed: Jan. 14, 2009

(65) Prior Publication Data

US 2010/0178160 A1 Jul. 15, 2010

(51) Int. Cl.
*F01D 11/08* (2006.01)

(52) U.S. Cl. ..... 415/173.7; 415/174.2

(58) Field of Classification Search ..... 415/199.5, 415/173.7, 174.1, 174.2, 174.5, 190; 416/193 A, 416/190, 193 R, 199
See application file for complete search history.

(56) References Cited

U.S. PATENT DOCUMENTS

| | | | | |
|---|---|---|---|---|
| 5,833,244 | A | 11/1998 | Salt et al. | |
| 6,464,453 | B2 | 10/2002 | Toborg et al. | |
| 7,252,481 | B2 | 8/2007 | Stone | |
| 7,410,345 | B2 | 8/2008 | Bracken | |
| 7,488,153 | B2 | 2/2009 | Reigl | |
| 7,520,718 | B2 * | 4/2009 | Engle | 415/173.7 |
| 2003/0180141 | A1 * | 9/2003 | Kress et al. | 415/115 |
| 2005/0129525 | A1 | 6/2005 | Bekrenev et al. | |
| 2008/0008582 | A1 | 1/2008 | Pickens et al. | |
| 2008/0050233 | A1 | 2/2008 | Steiger et al. | |
| 2008/0112793 | A1 | 5/2008 | Lee et al. | |

OTHER PUBLICATIONS

Rusetskiy, et al. "Gas Turbine packages of average capacity: the aspects of development": Gas Turbo Technology. Issue 2, 2009. HTTP://www.gtt.ru/en.

* cited by examiner

*Primary Examiner* — Caridad Everhart
(74) *Attorney, Agent, or Firm* — Cantor Colburn LLP

(57) ABSTRACT

A device for reducing secondary airflow in a gas turbine is disclosed. The device includes an inter-stage sealing member located between a plurality of first turbine buckets attached to a first rotor disk, and a plurality of second turbine buckets attached to a second rotor disk. The first rotor disk and the second rotor disk are rotatable about a central axis. The inter-stage sealing member is configured to be attached in a fixed position relative to the first rotor disk and the second rotor disk, and to contact the plurality of first buckets and the plurality of second buckets in a sealing engagement.

15 Claims, 2 Drawing Sheets

DEVICE AND SYSTEM FOR REDUCING SECONDARY AIR FLOW IN A GAS TURBINE

BACKGROUND OF THE INVENTION

The subject matter disclosed herein relates to gas turbines and, more particularly, to inter-stage seals in gas turbines.

Turbine components are typically directly exposed to high temperature gases, and therefore require cooling to meet their useful life. For example, some of the compressor discharge air is diverted from the combustion process for cooling rotor components of the turbine.

Turbine buckets, blades and vanes typically include internal cooling channels therein which receive compressor discharge air or other cooling gases for cooling thereof during operation. In addition, turbine rotor disks which support the buckets are subject to significant thermal loads and thus also need to be cooled to increase their lifetimes.

The main flow path of the turbine is designed to confine combustion gases as they flow through the turbine. Turbine rotor structural components must be provided with cooling air independent of the main gas flow to prevent ingestion of the hot combustion gases therein during operation, and must be shielded from direct exposure to the hot flowpath gas.

Such confinement is accomplished by rotary seals positioned between the rotating turbine buckets to prevent ingestion or back flow of the hot air or gases into interior portions of the turbine rotor structure. Such rotary seals are insufficient to completely protect the interior components, such as the rotor structure, rotor and rotor disks, requiring the additional use of purge flows of cooling air into and through the rotor cavity. Such additional measures to protect the interior components increase the cost and complexity and hinder the performance of gas turbines.

Accordingly, there is a need for improved systems and methods for cooling turbine engines, that reduce rotor cooling air purge flow levels, reduce complexity and preserve or improve turbine performance.

BRIEF DESCRIPTION OF THE INVENTION

A device for reducing secondary airflow in a gas turbine, constructed in accordance with exemplary embodiments of the invention includes: an inter-stage sealing member located between a plurality of first turbine buckets attached to a first rotor disk and a plurality of second turbine buckets attached to a second rotor disk, the first rotor disk and the second rotor disk being rotatable about a central axis. The inter-stage sealing member is configured to be attached in a fixed position relative to the first rotor disk and the second rotor disk, and to contact the plurality of first buckets and the plurality of second buckets in a sealing engagement.

Other exemplary embodiments of the invention include a gas turbine system including: a plurality of first turbine buckets attached to a first rotatable rotor disk; a plurality of second turbine buckets attached to a second rotatable rotor disk; a plurality of stationary radially extending turbine nozzles located axially between the first rotor disk and the second rotor disk; and a rotatable inter-stage sealing member attached to the first and second rotating disks, the rotatable sealing member configured to contact the plurality of first turbine buckets and the plurality of second turbine buckets to form a sealed flow path defined by the plurality of first and second buckets and at least one of the plurality of stationary nozzles and the sealing member.

Additional features and advantages are realized through the techniques of exemplary embodiments of the invention.

Other embodiments and aspects of the invention are described in detail herein and are considered a part of the claimed invention. For a better understanding of the invention with advantages and features thereof, refer to the description and to the drawings.

DETAILED DESCRIPTION OF THE INVENTION

Figure 1:
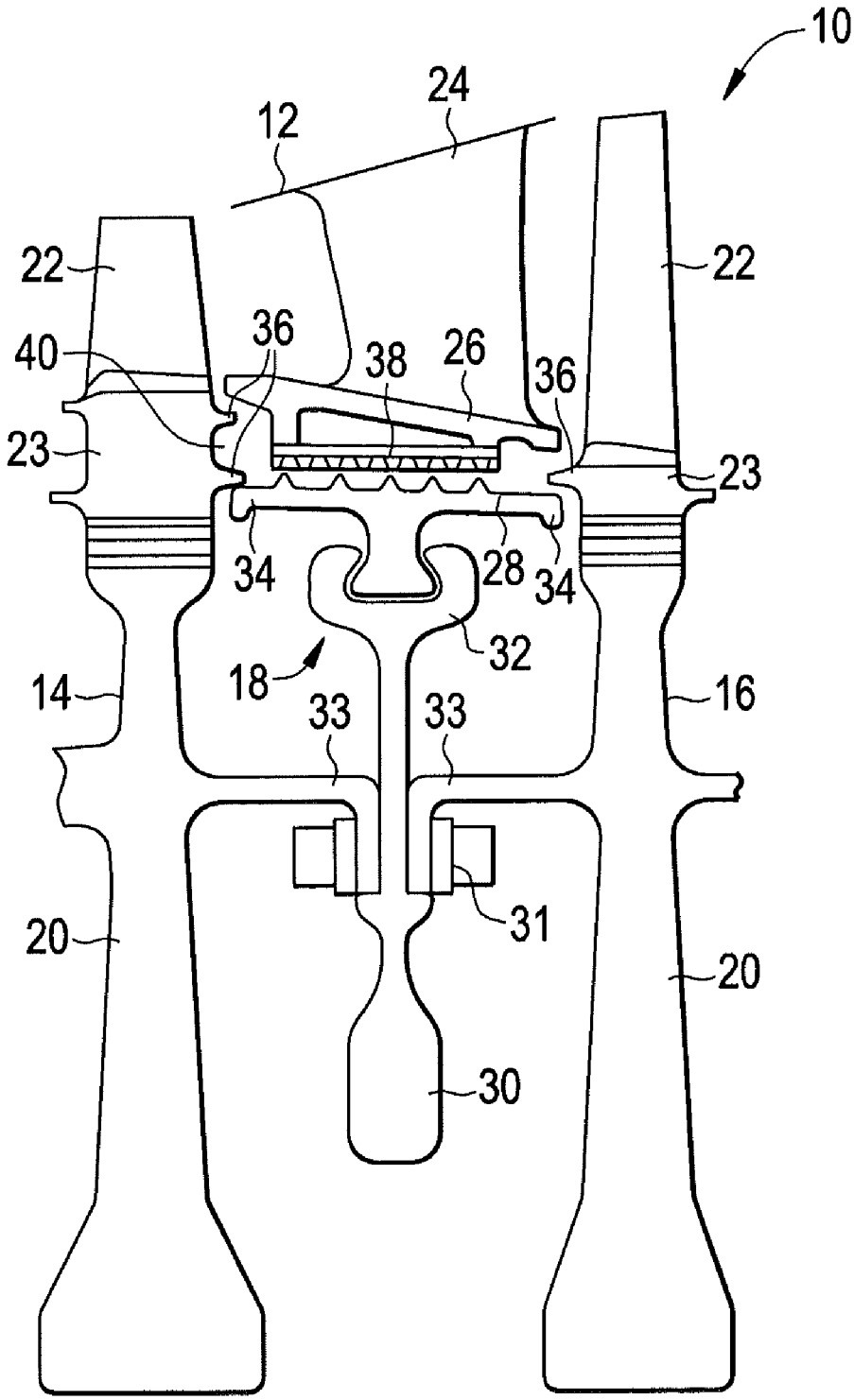
FIG. 1 is a side view of a portion of a gas turbine including a sealing assembly in accordance with an exemplary embodiment of the invention.

Referring to FIG. 1, a portion of a turbine section of a gas turbine constructed in accordance with an exemplary embodiment of the invention is indicated generally at 10. The turbine 10 includes alternating inter-stage nozzle stages 12 and turbine stages 14, 16. An inter-stage sealing assembly 18 is disposed between the turbine stages 14, 16. FIG. 1 shows a side cross-sectional view of a first turbine stage 14, a second turbine stage 16, and the nozzle stage 12 and sealing assembly 18 therebetween. Although the embodiments described herein are described with reference to the turbine section of a gas turbine, the embodiments may also be utilized in conjunction with various compression sections of a gas turbine.

Each turbine stage 14, 16 includes a rotor disk 20 that is attached to a rotor shaft (not shown) that causes the rotor disks 20 to rotate about a central axis. A plurality of blades or buckets 22 are removably attached to an outer periphery of each rotor disk 20. The buckets 22 are attached by any suitable mechanism, such as an axially extending dovetail connection. In one embodiment, the buckets 22 each include a bucket platform 23 configured to attach to the corresponding rotor disk 20. As used herein, an "axial" direction is a direction parallel to the central axis, and a "radial" direction is a direction extending from the central axis and perpendicular to the central axis. An "outer" location refers to a location in the radial direction that is farther away from the central axis than an "inner" location.

The nozzle stage 12 includes a plurality of nozzle vanes 24 that are connected to an outer casing assembly such as a turbine shell or an outer support ring attached thereto, and extend radially toward the central axis. In one embodiment, each of the nozzle vanes 24 are attached to an inner support ring, or segments forming a ring 26 having a diameter less than a diameter of the outer support ring, or segments forming a ring.

The inter-stage sealing assembly 18 is included to reduce or prevent heated gas or air from leaking into interior portions of the turbine 10 and away from the flow path defined by the buckets 22 and the nozzle stage 12. The sealing assembly includes a sealing member 28 that is attached in a fixed position relative to the rotating rotor disks 20, and therefore rotates along with the rotor disks 20. The sealing member 28 is also disposed against a surface of the buckets 22, such as against the bucket platforms 23, to cause a sealing connection between the sealing member 28 and the buckets 22. The corresponding gas flow path is accordingly defined by the buckets 22 and the inner support ring 26, with leakage of gas flow from the flow path being prevented by the sealing member 28.

The sealing member 28 is cast or otherwise made from high temperature materials capable of withstanding elevated temperatures such as 1500° F. Examples of such materials include nickel based superalloys such as those alloys used for flowpath components.

In one embodiment, the sealing member 28 is attached to an inter-stage disk 30 that is attached in fixed position relative to the rotor disks 20. In one embodiment, the inter-stage disk 30 is attached to the rotor disks by a bolt connection 31 or other suitable attachment to, for example, flanges 33. The attachment designs described herein are not limited. Any suitable attached mechanism may be used to attach the sealing member 28 in a fixed position relative to the rotor disks 20.

In one embodiment, the sealing member 28 is a continuous circumferential ring having an outer diameter less than an inner diameter of the nozzle inner support ring 26 and/or the nozzle vane 24. In another embodiment, the sealing member 28 is segmented and is attached to the inter-stage disk 30 by a removable connection such as a circumferential dovetail connection 32. In one embodiment, the sealing member 28 includes at least one extension 34 at each axial end of the sealing member 28 that contact at least one axially-extending protrusion 36 on each of the buckets 22 such as the bucket platforms 23. This contact between the extensions 34 and the protrusions 36 provides the seal between the buckets 22 and the sealing member 28. This contact can be metal-to-metal or contain a separate sealing feature between the extension 34 and the protrusion 36.

In one embodiment, the sealing member 28 is made from high temperature-resistant materials that can withstand the high temperature of the flow path. The sealing member 28 can be segmented with sealing features between circumferential segments, such as spline seals. The sealing member 28 is made from any of various materials such as metal castings, forgings, composite materials and ceramic materials. In another embodiment, cooling air or other cooling means are applied to the sealing member 28 to counteract the high temperatures in the flow path. The sealing member 28 thus protects the lower temperature rotating structures such as the rotor and rotor disks 20 from the hot gas of the flowpath, allowing for greatly reduced or eliminated rotor cavity purge flow levels since any local flow path ingestion occurs only on high temperature capable materials. In one embodiment, a buffer cavity 40 is formed between the sealing member 28 and the inner support ring 26. This cavity 40 is surrounded by the high temperature materials of the sealing member 28, ring 26 and bucket platforms 23.

Figure 2:
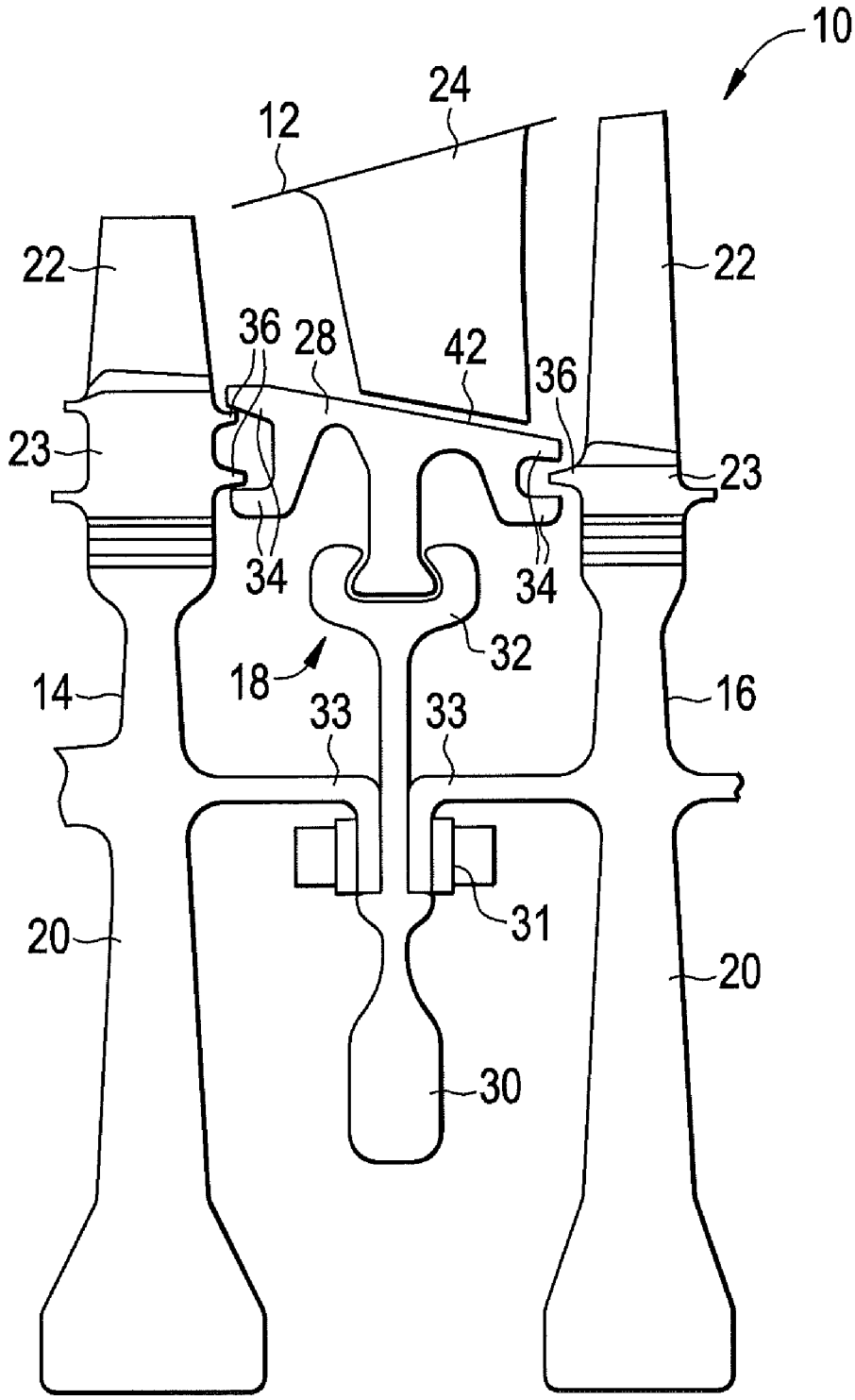
FIG. 2 is a side view of another exemplary embodiment of the sealing assembly of FIG. 1.

Referring to FIG. 2, another embodiment of the turbine section 10 is shown, in which the inner support ring 26 is omitted and the sealing member 28 forms the flow path along with the buckets 22. In this embodiment, the nozzle vanes 24 are individually attached to the turbine shell in a cantilever arrangement. In one embodiment, a controllable gap 42 is defined between the sealing member 28 and the nozzle 24.

In one embodiment, an exemplary method for reducing secondary airflow in a gas turbine is provided. The method includes disposing the rotor disks 20 in at least one of the compression section and the turbine section. The turbine nozzle vanes 24 are disposed axially between the rotor disks 20. The sealing member 28 is attached at a fixed position relative to the rotor disks 20, and disposed to contact the buckets 22. The combustion section is activated to cause rotation of the rotors 20 and direct an air flow through a conduit formed by the buckets 22 and at least one of the nozzle stages 12 and the sealing member 28. The sealing member 28 prevents or reduces leakage of the air flow from the conduit during operation of the turbine 10.

Although the systems and methods described herein are provided in conjunction with gas turbines, any other suitable type of turbine may be used. For example, the systems and methods described herein may be used with a steam turbine or turbine including both gas and steam generation.

The devices, systems and methods described herein provide numerous advantages over prior art systems. For example, the devices, systems and methods provide the technical effect of increasing efficiency and performance of the turbine by reducing the number of components and by reducing or eliminating the need for cooling gas flows. For example, the need for disk rim cover plates to seal the connection between the rotor disks and the buckets may be eliminated. Furthermore, the prevention of air flow leakage into interior cavities of the turbine reduces the level of cooling flow required, thus improving turbine efficiency and reducing cost.

In general, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of exemplary embodiments of the invention if they have structural elements that do not differ from the literal language of the claims, or if they include equivalent structural elements with insubstantial differences from the literal language of the claims.

The invention claimed is:

1. A device for reducing secondary airflow in a gas turbine, the device comprising:

an inter-stage sealing member located between a plurality of first turbine buckets attached to a first rotor disk and a plurality of second turbine buckets attached to a second rotor disk, the first rotor disk and the second rotor disk being rotatable about a central axis, the inter-stage sealing member being a circumferentially segmented structure including a plurality of segments and a sealing feature disposed between each of the plurality of segments; and an inter-stage rotor disk coupled to and supporting the sealing member in a fixed position relative to the first rotor disk and the second rotor disk, wherein the inter-stage sealing member is configured to engage the plurality of first buckets and the plurality of second buckets in a sealing engagement.

2. The device of claim 1, wherein the sealing member is made from a high temperature material capable of withstanding flowpath gas temperatures.

3. The device of claim 1, wherein the sealing member is an actively cooled structure.

4. The device of claim 1, wherein the inter-stage rotor disk is coupled to the sealing member by a circumferential dovetail connection.

5. The device of claim 1, further comprising an inner support ring and an inter-stage nozzle assembly including a plurality of stationary radially extending turbine nozzles located axially between the first rotor disk and the second rotor disk and connected to the inner support ring, the nozzle assembly and the plurality of first and second buckets forming an air flow path.

6. The device of claim 1, wherein the sealing member includes at least one extension member extending axially from each end of the sealing member.

7. The device of claim 6, wherein the at least one extension member is engageable with at least one axially extending protrusion on each of the plurality of first buckets and the plurality of second buckets to form the sealing engagement.

8. A gas turbine system comprising:

a plurality of first turbine buckets attached to a first rotatable rotor disk;

a plurality of second turbine buckets attached to a second rotatable rotor disk;

a plurality of stationary radially extending turbine nozzles located axially between the first rotor disk and the second rotor disk;

a rotatable inter-stage sealing member configured to be attached in a fixed position relative to the first and second rotor disks, the rotatable sealing member configured to sealingly engage the plurality of first turbine buckets and the plurality of second turbine buckets to form a sealed flow path defined by the plurality of first and second buckets and at least one of the plurality of stationary nozzles and the sealing member; and an inter-stage rotor disk coupled to and supporting the rotatable inter-stage sealing member in a fixed position relative to the first rotor disk and the second rotor disk, wherein the rotatable inter-stage sealing member is a circumferentially segmented structure including a plurality of segments and a sealing feature disposed between each of the plurality of segments.

9. The system of claim 8, wherein the sealing member is at least one of an actively cooled structure and a structure made from a high temperature material capable of withstanding flowpath gas temperatures.

10. The system of claim 8, further comprising an additional inter-stage rotor disk in a fixed position relative to the first rotor disk and the second rotor disk, the additional inter-stage rotor disk connected to the sealing member and supporting the sealing member in contact with the plurality of first buckets and second buckets.

11. The system of claim 8, wherein the inter-stage rotor disk is coupled to the sealing member by a circumferential dovetail connection.

12. The system of claim 8, further comprising an inner support ring, wherein the plurality of stationary nozzles are coupled to the inner support ring, and the inner support ring and the plurality of first and second buckets form an air flow path.

13. The system of claim 8, wherein the sealing member and the plurality of first and second buckets form a sealed air flow path.

14. The system of claim 8, wherein the sealing member includes at least one extension member extending axially from each end of the sealing member.

15. The system of claim 14, wherein each of the plurality of first buckets and the plurality of second buckets includes at least one axially extending protrusion, the axially extending protrusions of the pluralities of first and second buckets being engageable with the extension members of the sealing member to form the sealing engagement.

* * * * *